US006941787B2

(12) United States Patent
Flehmig et al.

(10) Patent No.: US 6,941,787 B2
(45) Date of Patent: Sep. 13, 2005

(54) BENDING DEVICE FOR THIN-WALLED METAL PIPES

(75) Inventors: Thomas Flehmig, Ratingen (DE); Uwe Kneiphoff, Dinslaken (DE); Thomas Neuhausmann, Moers (DE); Martin Kibben, Dinslaken (DE)

(73) Assignee: ThyssenKrupp Stahl AG, Duisburg (DE)

( * ) Notice: Subject to any disclaimer, the term of this patent is extended or adjusted under 35 U.S.C. 154(b) by 255 days.

(21) Appl. No.: 10/258,100

(22) PCT Filed: Feb. 10, 2001

(86) PCT No.: PCT/EP01/01479

§ 371 (c)(1),
(2), (4) Date: Mar. 17, 2003

(87) PCT Pub. No.: WO01/83130

PCT Pub. Date: Nov. 8, 2001

(65) Prior Publication Data

US 2003/0154756 A1 Aug. 21, 2003

(30) Foreign Application Priority Data

Apr. 27, 2000 (DE) ..... 100 20 725

(51) Int. Cl.[7] ..... B21B 9/07
(52) U.S. Cl. ..... 72/150; 72/466.2
(58) Field of Search ..... 72/150, 466, 466.2

(56) References Cited

U.S. PATENT DOCUMENTS 1,401,394 A * 12/1921 Curtis ..... 72/150
2,996,100 A * 8/1961 Newhall et al. ..... 72/369
3,279,237 A 10/1966 Rader et al.
3,580,044 A 5/1971 Voss
4,481,803 A 11/1984 Dieser
4,493,203 A 1/1985 Wheeler et al.

* cited by examiner

*Primary Examiner*—Lowell A. Larson
(74) *Attorney, Agent, or Firm*—Proskauer Rose LLP

(57) ABSTRACT

A bending device is described for thin-walled metal tubes (R) made of a straight tube guide (1), a core template (2), which adjoins the tube guide (1) and is pivotable in relation thereto, having a connection strip (3), and a mandrel, having a mandrel tip (4), which is flexible in the region of the core template (2), and a mandrel shaft (5), which adjoins the mandrel tip (4) and is rigidly connected thereto and is axially fixed (1) in the tube guide. In order to support the metal tube (R) to be bent over its entire surface on the inside in the active bending region during the bending procedure, the flexible mandrel tip (4), which comprises a radially incompressible solid cylinder made of elastomer, extends only over the starting section of the bending curve, where the bending procedure occurs. In order to pull the metal tube (R) to be bent over this mandrel tip (4), the tube is clamped in the region of the core template (2) for a short length using a spherical clamping head (7) insertable in the metal tube (R), the clamping head (7) being movable in relation to the mandrel tip (4) in the pivot region of the core template (2) and being attached to a traction means (6) implemented as a retrieval element.

11 Claims, 2 Drawing Sheets

BENDING DEVICE FOR THIN-WALLED METAL PIPES

BACKGROUND OF THE INVENTION

The present invention relates to a bending device for thin-walled metal tubes made of a straight tube guide, a core template, which adjoins the tube guide and is pivotable in relation thereto, having a connection strip, and a mandrel, having a mandrel tip, which is flexible in the region of the core template, and a mandrel shaft, which adjoins the mandrel tip and is rigidly connected thereto and is axially fixed in the tube guide.

Bending devices of this and similar types for thin-walled tubes are known (the magazine "Werkstatt und Betrieb" 104 (1971) 4, pp. 271 to 274, "Verhinderung von Faltenbildung und Einknicken dünnwandiger Rohre beim Biegen [Prevention of Wrinkling and Buckling of Thin-Walled Tubes During Bending]" by Prof. Dr.-Ing. G. Öhler, Bad D ürkheim). "Thin-walled" is understood in this context to mean tubes whose wall thickness is small in relation to the diameter and the bending radius, for example, tubes having a wall thickness of approximately 0.8 mm at a diameter of approximately 80 mm and a bending radius of approximately 120 mm. In order to keep the problems of wrinkling and deviation from a circular profile, which arise during bending of such tubes, as small as possible, the tube has been supported on its inner wall over the entire length of the bending curve using mandrels fixed axially in the tube. Therefore, there are mandrels supporting the tube over the entire bending curve which have a bendable section in the form of helical springs having turns pressed tightly together or in the form of ball links which form a link chain (U.S. Pat. No. 4,481,803). Both types of mandrels have the disadvantage that the tube to be bent is not supported over its complete surface in the region where the tube is bent. Most critical is the incomplete support on the inner curve, where wrinkles may form. With linked mandrels made of ball links, gaps are present from the beginning on the inner curve, so that the danger of wrinkling is particularly great for them.

A further problem in the known bending devices is the clamping of the beginning of the tube. Support on a rigid cylindrical mandrel head is problematic, because such a mandrel head, which requires a relatively large clamping length for fixed clamping of the tube, cannot be pulled back through the bent tube.

SUMMARY OF THE INVENTION

The present invention is based on the object of providing a bending device of the type initially described which manages with a short clamping length of the beginning of the tube and which allows the production of a curve having a circular cross-section over its entire length.

This object is achieved using a bending device of the type initially described in that the mandrel tip is implemented as a solid cylinder, made of an elastomer, whose external contour is tailored to the inner contour of the metal tube to be bent and which is practically incompressible radially, and which extends over only the starting cross-section of the bending curve, and a spherical clamping head, insertable into the metal tube, is provided in the region of the core template and its connection strip, this clamping head being movable in relation to the mandrel tip in the pivot range of the core template and being attached to a traction means implemented as a retrieval element.

In the bending device according to the present invention, the metal tube is supported on the inside "all over" in the starting section of the bending curve, which is active in bending, by the flexible, but radially practically incompressible solid cylinder made of elastomer, so that in this section, which is decisive for the shaping, no constrictions or wrinkles may form. This is essentially true even if the solid cylinder, for the purpose of improving its flexibility, has radial slots at least on the outside in the bending curve or is constructed from disks. This is because, in contrast to mandrel tips constructed from helical screws or link chains, the radial slots in a mandrel tip constructed from a solid cylinder made of elastomer open comparatively slightly due to the elastomer. Optimum internal support using disks may be achieved with a purposely adjustable flexibility if elastomer disks having differing modules of elasticity are used. In the region further toward the mandrel tip, a certain radial compressibility may be very advantageous for the bending result, because better flexibility is, as a rule, connected therewith. Using the clamping head, at least rounded on both ends, and particularly spherical, which is moved with the core template as the core template pivots, the metal tube may be sufficiently strongly clamped even on a shorter length. There are also no problems when pulling back the mandrel after the bending procedure is complete, because the clamping head may pass the bending curve without problems, particularly without jams, due to its short length and spherical shape. In addition, it may also have a smoothing and reprofiling effect on the metal tube.

In order to improve the flexibility of the solid cylinder in the bending curve, in addition to the possibility of radial slots or the construction from disks, particularly disks made of different elastomers, there is also the possibility of providing axial slots, like a laminated mandrel. The flexural strength of the solid cylinder over its length may also be set easily in this way if a very few axial holes of different diameters and different depths are introduced into the solid cylinder, distributed from the face out. Of course, a slight reduction of radial stiffness must be accepted in this case. It is then left to the decision of the practitioner whether any compromise is to be made, and if so, how large a compromise. However, in all cases the slotted cross-section is preferably restricted to the region above the neutral fiber of the curved mandrel tip.

The present invention provides two alternative possibilities for the retrieval (pulling back) of the mandrel and the clamping head after the bending procedure is completed: according to the first alternative, the traction means is at least flexible within the bending curve, runs without play through the mandrel tip and is fixed in the mandrel tip and/or the mandrel shaft, and is also movably guided by the clamping head up to a stop. In this case, a pressure spring is preferably inserted between the clamping head and the stop, which, in the unloaded state, keeps the clamping head pressed against the face of the mandrel. This starting position makes inserting the mandrel for preparing the bending procedure easier. According to the other alternative, on one end, the traction means is flexible at least within the bending curve and runs through the mandrel tip and the mandrel shaft and, on the other end, is connected to the clamping head. In this case, the retrieval force may engage directly on the traction means.

There are also multiple possibilities for the implementation of the clamping head. The clamping head may comprise a slotted, spherical external ring and an internal support and clamping cone, which has a self-clamping effect on the external ring during the bending procedure. In this alternative, the tractive force exercised on the tube during the bending procedure is transmitted to the clamping ring and the clamping cone and is used to expand the external ring and therefore to produce a more solid clamping effect, while the force exercised by the traction means during retrieval of the clamping head acts to loosen it. Alternatively, the clamping head may also comprise multiple ball links, particularly two, which form a rigid unit. Due to the central constriction and the roundings, there are also no jams in the tube curve as the clamping head is pulled back in this case. This achievement of the object is distinguished above all by optimal guiding and especially good reprofiling properties, with a simple construction.

Since the traction means becomes more and more free between the mandrel and the clamping head as the bend increases during the bending procedure, it is advantageous to have it run eccentrically through the metal tube toward the tube inner curve. The advantage is that the traction means may support itself on the inner curve of the tube inner wall as it is pulled back.

DETAILED DESCRIPTION OF THE INVENTION

In the following, the present invention is described in more detail with reference to a drawing illustrating two exemplary embodiments. Both figures show the bending device at the end of the bending procedure in axial cross-section.

Figure 1:
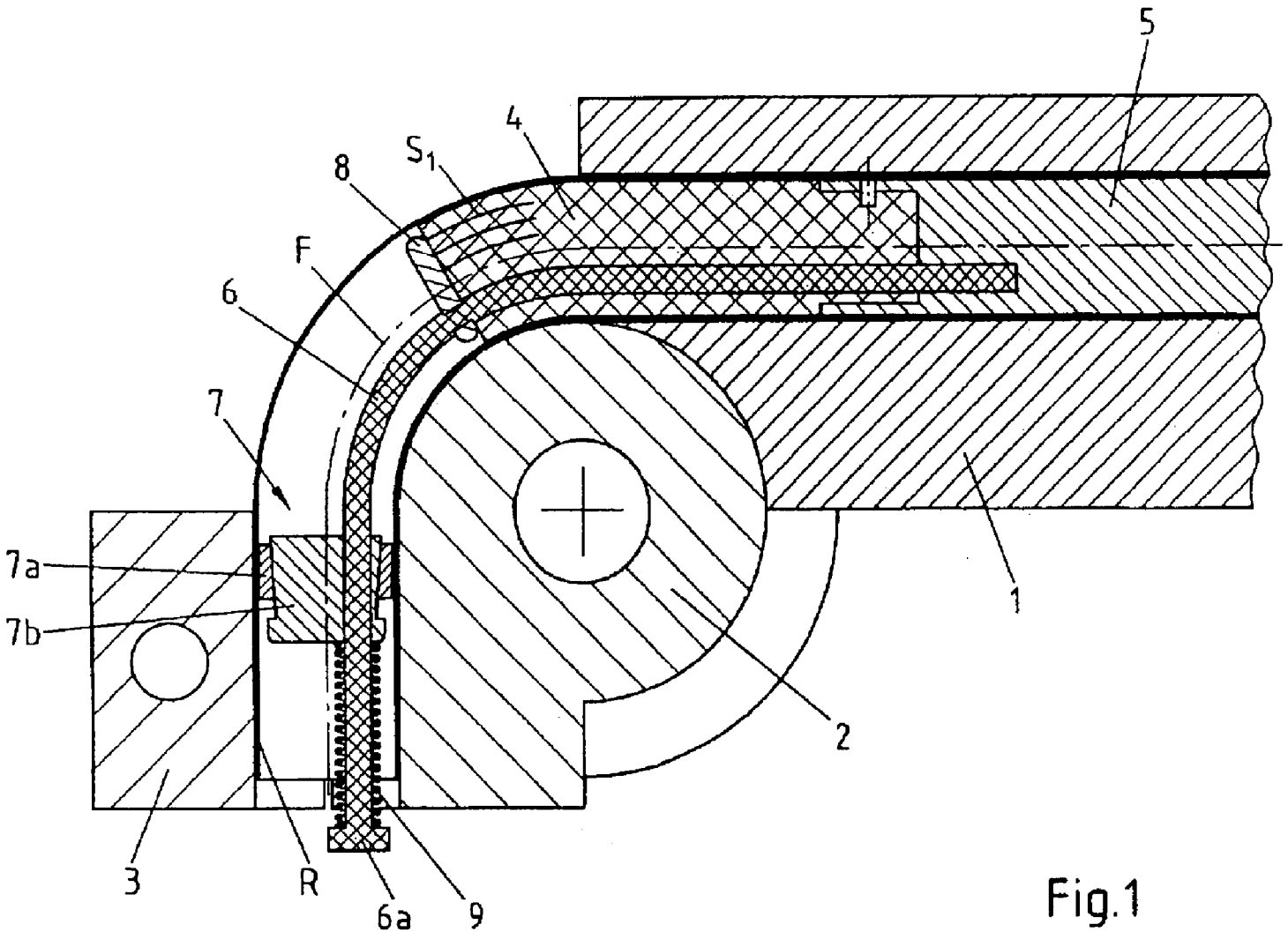
FIG. 1 shows the bending device at the end of the bending procedure in axial cross-section.
Figure 2:
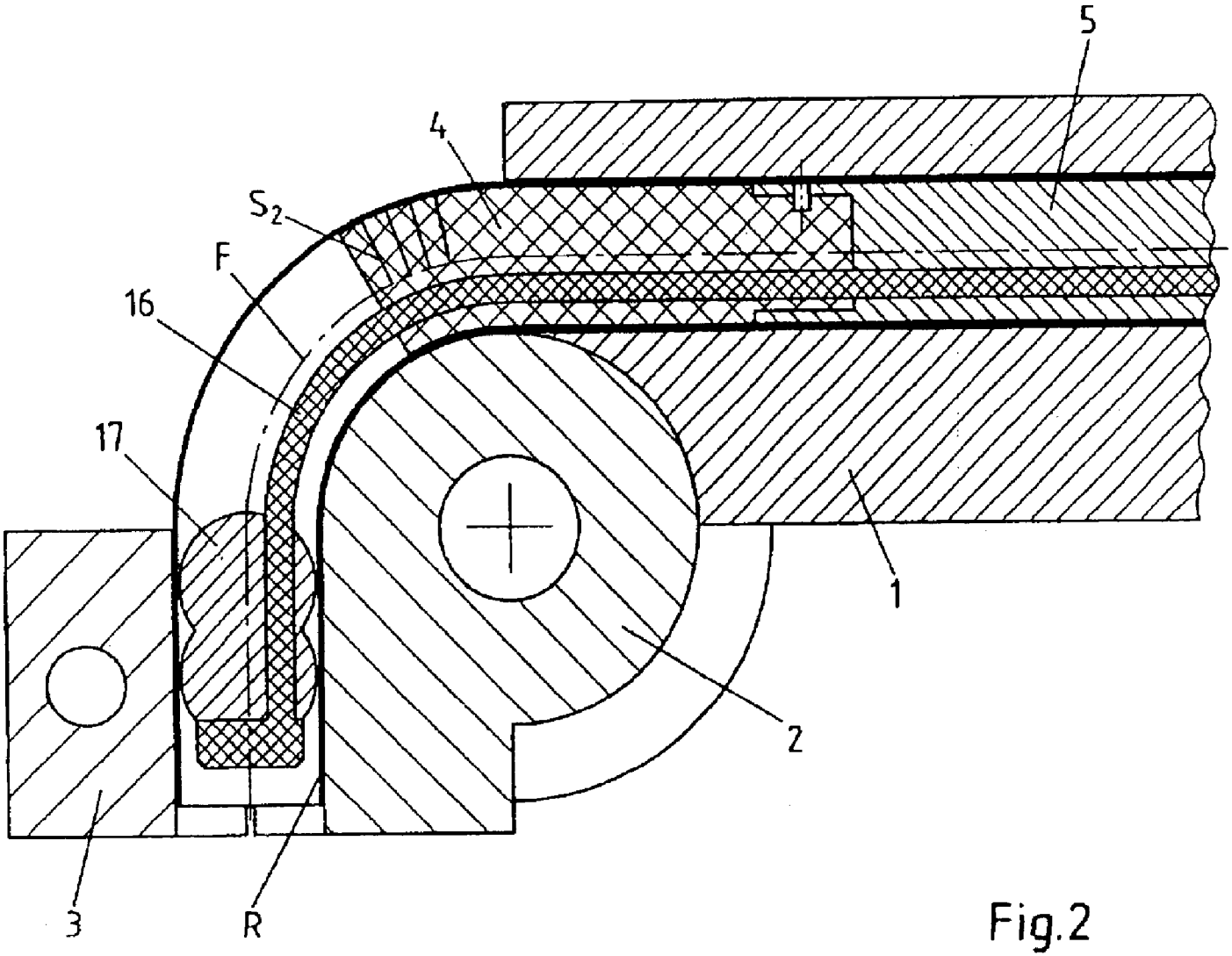
FIG. 2 shows thebending device at the end of the bending procedure in axial cross-section with the clamping head and the traction means different from that of the bending device shown in FIG. 1.

The bending device shown in FIG. 1 comprises a fixed straight tube guide 1, an adjoining pivotable core template 2, having a connection strip 3, and a mandrel, having a mandrel tip 4 positioned in the region of core template 2 and an adjoining mandrel shaft 5, rigidly attached to mandrel tip 4 and located in the region of tube guide 1. Mandrel tip 4 and mandrel shaft 5 are axially fixed during the bending procedure. Mandrel tip 4 comprises a solid cylinder made of elastomer, which is flexible, but, in regard to the deformability of the tube material, is practically incompressible radially. In practice, hardnesses in the magnitude from 95 Shore A to 50 Shore D are suitable for steel tubes. To improve the flexibility, the solid cylinder may be slotted toward the outer curve in the section above its neutral fiber F, which is active in bending, and may have axial slots S1 (FIG. 1) or radial slots S2 (FIG. 2).

As traction means 6, a cable runs eccentrically offset through mandrel tip 4 and mandrel shaft 5 toward core template 2 and therefore toward the inner curve. Traction means 6 is axially fixed in mandrel shaft 5 and is seated with slight play in mandrel tip 4, which is favorable for the radial incompressibility of mandrel tip 4, unless a certain compressibility is intentionally accepted to favor elevated flexibility, above all in the region toward mandrel tip 4, possibly even using further axial holes of different cross-sections and different depths and at a sufficient distance from the external circumference, which may be completely practical for elastomer which is initially very incompressible. A pressure disk 8, which is axially fixed in a groove on traction means 6 and minimizes axial deviation of the elastomer material of the solid cylinder, consequently reducing its diameter, presses against the face of mandrel tip 4. Traction means 6 extends further through a clamping head 7. A pressure spring 9 is seated on traction means 6 between clamping head 7 and a stop 6*a*. Clamping head 7 comprises a slotted, spherical external ring 7*a* and an internal support and clamping cone 7*b*. Tube R to be bent may be clamped over a short length between external ring 7*a* and the straight section of core template 2 and connection strip 3.

The mode of operation of the bending device according to the present invention in the exemplary embodiment of FIG. 1 is as follows:

Tube R to be bent is inserted, with the straight section of core template 2 in an aligned position with tube guide 1. Subsequently, the mandrel, having mandrel tip 4 and mandrel shaft 5, with clamping head 7 pressed against mandrel tip 4, is inserted into tube R until mandrel tip 4 lies in the region of core template 2. Connection strip 3 is then tensioned using core template 2 and clamping head 7, through which tube R is clamped. Mandrel shaft 5 is axially fixed in tube guide 1 in this axial position by means not shown in the drawing.

If core template 2 is now pivoted counterclockwise, then tube R, clamped by core template 2 and connection strip 3, is carried along and drawn over axially fixed mandrel 4. Due to the conical seat of clamping head 7, the tractive forces, which have a self-clamping effect on external ring 7*a*, ensure that the clamping force is amplified. Tube R reaches the curved region of core template 2 and initially straight mandrel tip 4 becomes more and more curved, tube R being continuously supported on its inner wall in the active bending region during the bending procedure, so that no wrinkles or constrictions may form.

After the bending procedure is completed, connection strip 3 is loosened and the mandrel, with clamping head 7, is pulled back through bent tube R. At the same time, the clamping effect of clamping head 7 due to the conical seat is removed because of the forces now acting in the opposite direction. At the end of this procedure, pressure spring 9 presses clamping head 7 back into its starting position on the face of mandrel tip 4. Bent tube R may then be removed and core template 2 may be pivoted back into its starting position, so that a new tube to be bent may be inserted.

The exemplary embodiment of FIG. 2 differs from that of FIG. 1 only in the clamping head and the traction means. In cases of correspondence, the same reference numbers are used for the individual parts as in FIG. 1.

Clamping head 17 comprises multiple, particularly two, ball links, rigidly connected to one another, which are connected to a cable as traction means 16. Alternatively, clamping head 17 may also comprise a one-piece, rigid, short body having an external contour similar to a bellows. Traction means 16 is guided movably through mandrel tip 4 and mandrel shaft 5. During pivoting, it may therefore be loosened. For the retrieval, the retrieval force engages on traction means 16, which is guided outward. In this case, clamping head 17 is first pulled back through the tube until it stops against the face of the mandrel tip. Clamping head 17 is then pulled back together with mandrel tip 4 and mandrel shaft 5. Jamming in the tube curve may not occur, in spite of the rigid unit of the ball links, due to their good axial guiding on axially offset positions and their shape. Their roundings and their central constriction provide sufficient clearance for the curved tube and also have a reprofiling effect on tube R as they are retrieved. Of course, if there are more than two ball links, e.g., three links, the contour of the central link must be set back at least at the inner curve. This is correspondingly true for a clamping head similar to a bellows.

What is claimed is:

1. A bending device for bending thin-walled metal tubes, comprising:

a straight tube guide, a core template which adjoins the tube guide and is pivotable in relation thereto, said core template having a connection strip, a mandrel having a mandrel tip which is flexible in a region in proximity to said core template, and a mandrel shaft which adjoins the mandrel tip and is rigidly connected thereto and is axially fixed in said tube guide, wherein said mandrel tip comprises a solid cylinder made from an elastomer, said mandrel tip having an external contour which conforms to an inner contour of a metal tube to be bent, said mandrel tip being substantially incompressible radially, said mandrel tip extending into only a starting cross-section of a bending curve defined by the mandrel, said mandrel further comprising a clamping head which is insertable into the metal tube to be bent, said clamping head being positioned in a region of the core template and the connection strip, said clamping head being movable relative to the mandrel tip in a pivot range of the core template, and a traction unit attached to said clamping head, said traction unit comprising a retrieval element for said clamping head.

2. The bending device of claim 1, wherein the mandrel tip includes radial or axial slots.

3. The bending device of claim 2, wherein the mandrel tip comprises elastomer disks held against one another by axial pre-tension in a face region of said mandrel tip.

4. The bending device of claim 3, wherein said elastomer disks have a variety of modules of elasticity.

5. The bending device of claim 1, further comprising a pressure disk located on a face of the mandrel tip.

6. The bending device of claim 1, wherein the retraction unit is flexible at one end in the bending curve up to the mandrel tip, and is fixed in the mandrel tip substantially without play or is fixed to the mandrel shaft, and on an opposite end is movably guided through the clamping head up to a stop.

7. The bending device of claim 6 further comprising a pressure spring located between the clamping head and the stop.

8. The bending device of claim 1, wherein on one end, the traction unit is flexible at least in the bending curve and runs movably through the mandrel tip and the mandrel shaft, and on an opposite end is connected to the clamping head.

9. The bending device of claim 1, wherein the clamping head comprises a slotted external ring and an internal support and clamping cone which, during bending, has a self-clamping effect on the external ring.

10. The bending device of claim 1, wherein the clamping head comprises multiple ball links which form a rigid unit.

11. The bending device of claim 1, wherein the traction means runs eccentrically through the metal tube to be bent towards an inner curve of the metal tube.

* * * * *